US005318209A

United States Patent [19]

Rader et al.

[11] Patent Number: 5,318,209

[45] Date of Patent: Jun. 7, 1994

[54] SKI AND SKI POLE CARRIER

[75] Inventors: June S. Rader; Joseph P. Rader, both of Boulder, Colo.

[73] Assignee: Camas Corporation, Boulder, Colo.

[21] Appl. No.: 867,717

[22] PCT Filed: Jan. 4, 1991

[86] PCT No.: PCT/US91/00091

§ 371 Date: Jul. 2, 1992

§ 102(e) Date: Jul. 2, 1992

[87] PCT Pub. No.: WO91/09551

PCT Pub. Date: Jul. 11, 1991

Related U.S. Application Data

[63] Continuation-in-part of Ser. No. 461,087, Jan. 4, 1990, Pat. No. D. 323,585.

[51] Int. Cl.[5] ..... A45F 3/14

[52] U.S. Cl. ..... 224/250; 224/257; 224/258; 224/264; 224/917; 294/147

[58] Field of Search ..... 224/257, 258, 264, 917, 224/250; 294/147

[56] References Cited

U.S. PATENT DOCUMENTS

| | | | |
|---|---|---|---|
| 3,920,166 | 11/1975 | Hogensen, Jr. | 224/917 |
| 4,673,118 | 6/1987 | Kronz | 224/259 |
| 4,705,281 | 11/1987 | Spinas | 224/917 |
| 4,815,640 | 3/1989 | Johnson | 224/258 |
| 4,852,931 | 8/1989 | Ferdi | 224/917 |

FOREIGN PATENT DOCUMENTS

| | | |
|---|---|---|
| 3606832 | 9/1987 | Fed. Rep. of Germany . |
| 167201 | 2/1934 | Switzerland . |

*Primary Examiner*—Linda J. Sholl

*Attorney, Agent, or Firm*—Dorr, Carson, Sloan & Peterson

[57] ABSTRACT

A shoulder strap ski carrier for transporting a pair of skis and ski poles in an substantially vertical position behind a skier's shoulder and beside a portion of the waist and hip. The carrier having an upper shoulder strap with shoulder padding attached thereto and a lower adjustable strap. The upper shoulder strap having opposite ends attached to a front loop and a rear loop. The lower adjustable strap is divided into a front strap and a rear strap. The front strap has an upper end threaded through the front loop and attached to a front triglide slidably mounted on the front strap. The rear strap has an upper end threaded through the rear loop and attached to a rear triglide slidably mounted on the rear strap. The front strap and rear strap come together at an angle and are joined to form a saddle for receiving a portion of the skis therein. The front and rear straps each have lower ends which are wrapped around the skis and joined together by an attachment material. The saddle of the front and rear strap also has a ski pole strap attached thereto for wrapping around a portion of a pair of ski poles and securing the poles adjacent the skis.

21 Claims, 2 Drawing Sheets

SKI AND SKI POLE CARRIER

RELATED APPLICATIONS

This application is a continuation-in-part of U.S. Pat. application Ser. No. 461,087 filed Jan. 4, 1990, now U.S. Pat. No. D323,585 issued Feb. 4, 1992 and a continuing national filing under the Patent Cooperation Treaty of International Application No. PCT/US91/00091 filed Jan. 4, 1991.

BACKGROUND OF THE INVENTION (a) Field of the Invention

This invention relates to a carrier for carrying a pair of skis, and more particularly, but not by way of limitation, to a flaccid strap ski carrier designed to be carried over a single shoulder and capable, with the use of a single loop, of holding a pair of skis together and in a substantially vertical position, and with the use of another loop, of holding a pair of ski poles.

(b) Description of the Prior Art

Heretofore there have been a variety of different types of shoulder strap ski carriers wherein two opposite ends of a strap or a belt are secured near the ski tips and ski tails, and the strap or belt is placed over the shoulder similar to a sling. Such carriers and holders are known to be described in the following U.S. Pat. No. 2,118,302 to Windheim; U.S. Pat. No. 2,530,695 to Helmert; U.S. Pat. No. 3,960,302 to Mazzoni, Jr.; U.S. Pat. No. 4,470,528 to Dyess; and U.S. Pat. No. 4,792,073 to Jacober. Also, these types of carriers are shown in French Patent 2,571,625 to Derbin et al, and Swiss Patent 318,337 to Lutz. None of these above-mentioned patents disclose or teach the use of a shoulder strap with a single strap connection which, when securing a pair of skis thereto and held by a standing user over a single shoulder, automatically holds the skis in a substantially vertical position.

In U.S. Pat. Nos. 3,841,542 and 3,920,166 to Hogensen, and Norwegian Patent 44,397 to Borchgrevink, shoulder strap ski carriers are disclosed with a single lower strap used for fastening around a mid-portion of a pair of skis with the skis balanced thereon. In each of these known references, with a single lower strap used for fastening around a mid-portion of a pair of skis, the skis are then carried in an awkward horizontal orientation of the skis, which causes the user and skis to have a difficult profile for travelling through narrow spaces, which requires the user to continuously and consciously steer both the front and back of the skis, and which may lead to the touching or spearing of others with skis or ski poles. None of these above-mentioned patents disclose or teach the use of a shoulder strap with a single strap connection which, when securing a pair of skis together and held by a standing user over a single shoulder, automatically hold the skis close to the body in a substantially vertical position, with the hands of the user totally free. None of the known prior art patents provide a feature which allows for the uniform adjustability of such a shoulder strap carrier for skiers of different heights and for skis of different lengths. Also, none of these above-mentioned patents disclose or teach the use of a shoulder strap ski carrier to which ski poles can also be secured in a vertical orientation, and yet from which the poles can be easily removed with out also removing the skis, to allow a user to carry the poles separately, for example, as is required when boarding a bus or gondola.

SUMMARY OF THE INVENTION

It is therefore an object of the present invention to provide a shoulder strap carrier for the hands free holding of a pair of skis in an substantially vertical position close to the body of the user, which carrier utilizes a single connection to hold the skis together and in a vertical position.

Another object of the present invention is the provision of a single connection strap and saddle combination which, when wrapped around a pair of skis automatically, holds the skis together and positions them in a vertical orientation when suspended from a strap carrier.

Still another object of the present invention is to provide such a carrier which can be used to hold a pair of skis and ski poles close to the body of the user, adjacent to the rear of a shoulder, leaving the hands free for other use.

Yet another important object of the present invention is to provide such a carrier which, because the carrier holds the skis and poles vertically, allows a user to walk safely among others without fear of being caught in a narrow space or of sticking or spearing another person with horizontal skis or poles.

Another object of the present invention is to provide such a carrier with a quick release single ski pole strap so that the skis with the shoulder strap carrier attached thereto can be carried on the exterior of a vehicle, and, as is often required, the ski poles can be carried by the skier inside of the vehicle.

Another object of the present invention is to provide such a ski carrier strap which can be quickly and easily attached to a pair of skis and ski poles.

A further object of the invention is to provide a ski and pole carrier that is lightweight, streamlined, simple and rugged in construction, colorful and pleasing to the eye, and made of durable material.

Yet another object of the invention is to provide such a carrier which can be uniformly vertically adjusted while maintaining its verticalness for users of different heights, and skis of different lengths.

A still further object of the present invention is to provide such a carrier which is constructed to be easily folded compactly for storing in a ski parka pocket, fanny pack, and the like when the carrier is not in use.

Yet still another object of the invention is to provide such a carrier in which the shoulder strap is padded for comfort and ease when transporting skis and poles.

The present invention provides a shoulder strap ski carrier for transporting a pair of skis and ski poles in an substantially vertical position close to the body of the user, behind one shoulder and beside a portion of the waist and hip. The carrier has a flaccid upper shoulder strap with shoulder padding attached thereto and two lower adjustable straps. The upper shoulder strap has opposite ends attached to a front loop and a rear loop. The lower adjustable strap includes a front strap and a rear strap. The front strap has an upper end threaded through the front loop and attached to a slidable "triglide" mounted on the front strap. The rear strap has an upper end threaded through the rear loop and attached to a slidable triglide mounted on the rear strap.

A portion of the front strap and rear strap which is adjacent to their lower ends come together at an angle and are joined and interwoven to form a relatively rigid saddle for receiving a portion of the skis therein. The front and rear straps each have lower end portions, below the saddle, which lower end portions are designed to be wrapped around a pair of skis, and then connected to one another to hold the skis together, and with the saddle, positions the skis in a vertical orientation when suspended from a strap carrier. This combination provides a shoulder strap carrier which is connected to the strap and saddle combination, and which, when wrapped around a pair of skis, holds the skis together and automatically positions them in a vertical orientation when suspended from the shoulder strap carrier. This allows for the holding of a pair of skis in an substantially vertical position close to the body of the user, adjacent to the rear of a shoulder, leaving the hands free for other use.

In preferred embodiments, the saddle formed by the front and rear straps has a ski pole carrier strap attached to its back, which ski pole carrier strap is designed to be wrapped around a pair of ski poles to hold the ski poles together and secure the poles in a vertical orientation adjacent to the skis. This leaves the skis easily accessible for removal from the carrier, without the necessity of also removing the skis.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
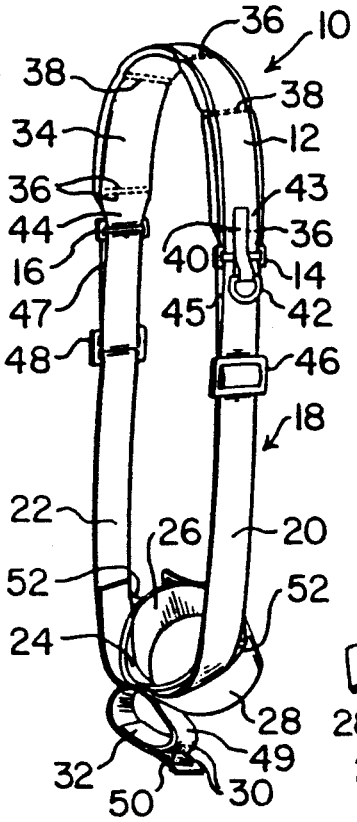
FIG. 1 is a perspective rear view of the shoulder strap ski carrier with the ski holding straps and ski pole holding strap in a closed attached position without skis or poles.
Figure 4:
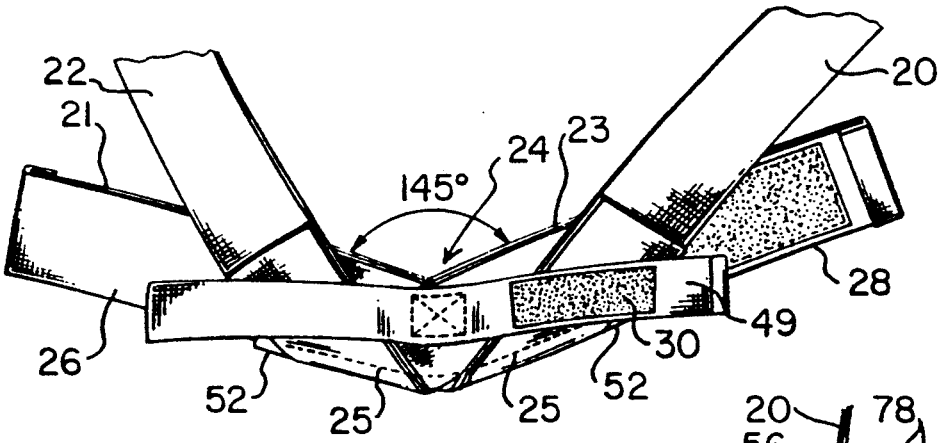
FIG. 4 is an enlarged front view of a saddle formed of the lower adjustable strap, which shows the details of the saddle structure, the straps adjacent to the saddle, and the gussets between the saddle and the adjustable straps.
Figure 8:
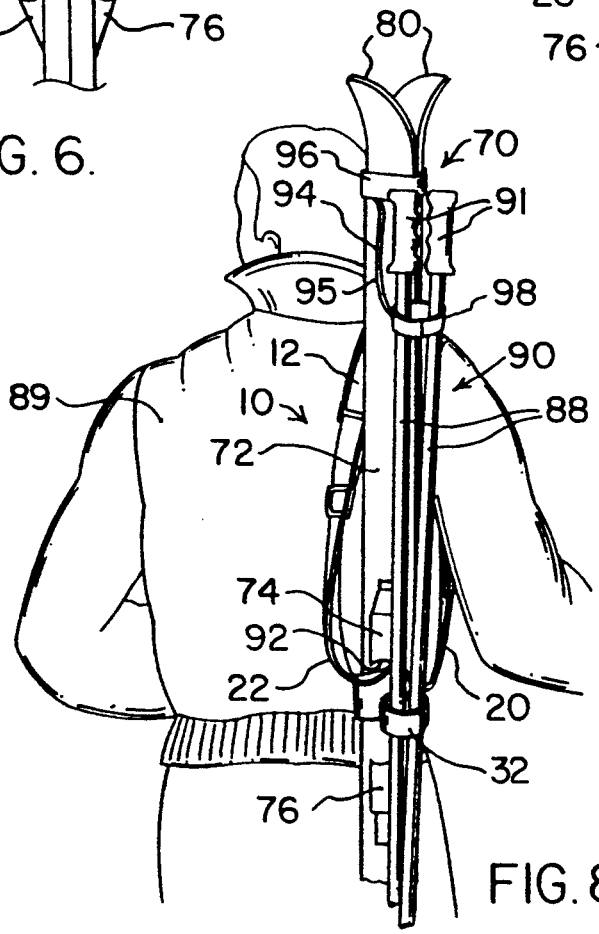
FIG. 8 illustrates a rear view of a skier using the subject invention with a pair of skis and poles securely fastened to the carrier and held in a vertical position behind the right shoulder of the skier and beside a portion of the skier's waist and hip.

In FIG. 1 a rear perspective view of the subject shoulder strap ski carrier is shown and designated by general reference numeral 10. The carrier 10 includes broadly an upper shoulder strap 12 attached to a front loop 14 and a rear loop 16, a lower adjustable strap having a general reference numeral 18, and including a front strap 20 and a rear strap 22. Adjacent to their lower ends, 26 and 28, respectively, front strap 20 and a rear strap 22 each have an additional strap portion, 21 and 23 respectively, connected thereto, in this instance by stitching, as shown in FIG. 4. As further shown by FIG. 4, front strap 20 and a rear strap 22 and additional strap portions 21 and 23 are interwoven and joined together in this area to form a relatively rigid saddle 24. As shown in FIG. 4, the portion of straps 20 and 21 and 22 and 23 just above and prior to saddle 24 is folded down along the rear of saddle 24, and connected, in this instance by stitching, to the rear of saddle 24 at stitch lines 25. This causes relatively rigid saddle 24 to be oriented at an approximately 90° angle to straps 20 and 22. Additional strap portions 21 and 23 provide substantial additional rigidity to the lower ends 20 and 22, respectively, which rigidity is important to the structural integrity of saddle 24, but other means of adding rigidity, such as the use of thicker strap material or coating the ends of the straps, for example with semi-rigid plastic, would achieve substantially the same result. Lower end 26 of the front strap 20 and a lower end 28 of the rear strap 22, including additional strap portions 21 and 23 are designed and positioned to be wrapped around a portion of a pair of skis and secured together using an attachment mechanism 30 such as Velcro hook and loop material. Referring to FIG. 8, when a pair of skis 70 are placed in the saddle 24 and straps 21–22 and 23–24 wrapped around the skis, preferably just below toe bindings 92, the skis are held together within the strap and saddle combination. Then, when saddle 24 is lifted by strap combination 12 and 18, the orientation of saddle 24, as detailed above, causes the vertical orientation of skis 70.

A separate ski pole holding strap 32 is attached to the rear of saddle 24. Ski pole holding strap 32 can be used to wrap around a portion of a pair of ski poles and secured together using attachment material 30.

The upper shoulder strap 12 includes shoulder padding 34 along the length and on the bottom side of the strap 12. Padding 34 is preferably formed of foam material covered by cloth. The padding 34 is secured to the strap 12 using cross stitching 36 at spaced intervals. In some instances, stitching 36 forms fold lines 38 perpendicular to the length of the strap 12 which allow carrier 10 to be easily folded compactly for fitting in a ski parka pocket, fanny pack, and the like. It should be mentioned that the carrier straps and padding are made of a soft, yet strong and pliable, polypropylene, nylon, or like materials. Relatively rigid saddle 24 is small enough and flexible enough so that it does not interfere with this folding and storing operation.

The strap 12 also includes an accessory tab 40 attached thereto with one end having a "D" ring 42 mounted thereon for holding ski gloves, glasses, etc. when the carrier 10 is in use. Further, the strap 12 includes opposite ends 43 and 44 which are threaded through the front loop 14 and rear loop 16 and folded back and stitched to itself, thereby securing the upper shoulder strap 12 to loops 14 and 16.

The front strap 20 of the lower shoulder strap 18 includes an upper end 45 which is threaded through the front loop 14 and folded back and attached to a front triglide 46 slidably mounted on the strap 20. A triglide is similar to a buckle. The rear strap 22 is similar to the front strap 20 and also includes an upper end 47 which is threaded through the rear loop 16 and folded back and attached to a rear triglide 48 slidably mounted on the strap 22. By adjusting the upper ends 45 and 47 on the triglides 46 and 48, the lower shoulder strap 18 can be moved vertically up and down, as detailed below in the further discussion of FIGS. 2 and 3.

At the bottom of the lower strap 18 the front strap 20 and the rear strap 22 and additional straps 21 and 23 merge, interweave and cross at an angle, as shown in FIGS. 4. Lower ends 26 and 28 are used with saddle 24 to hold a pair of skis together. The lower ends 26 and 28 are shown attached to each other in FIG. 1, but without skis, and in FIGS. 5 and 8 with skis. Also, opposite ends 49 and 50 of the ski pole strap 32 are joined together in FIG. 1 with attachment material 30, but without ski poles secured therein.

Figure 2:
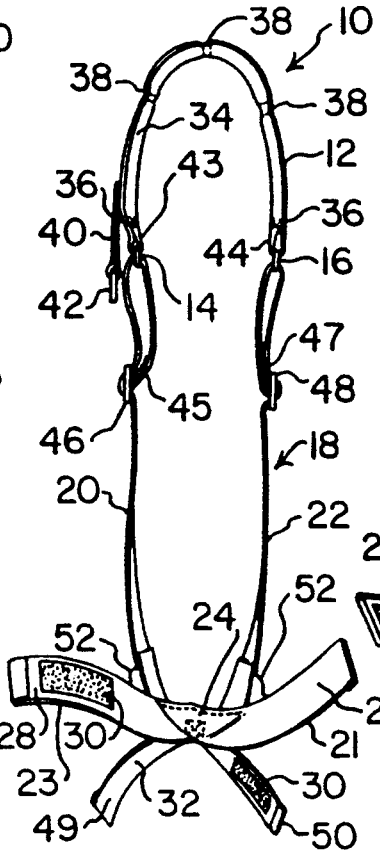
FIG. 2 is a perspective front view of the ski carrier with the ski holding straps in an open position for receiving a portion of a pair of skis therein, and the ski pole holding strap in an open position for receiving a portion of a shaft of the ski poles.
Figure 3:
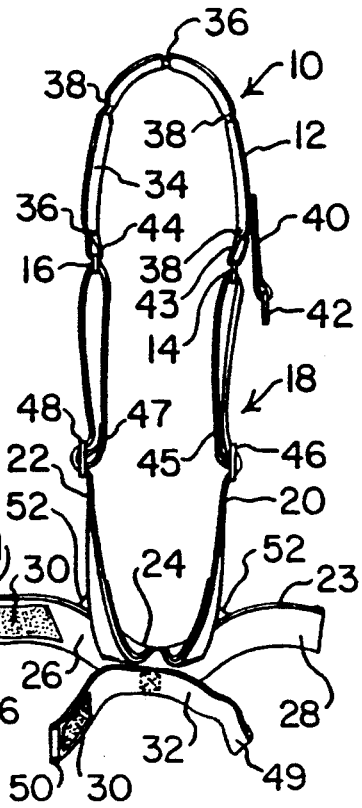
FIG. 3 is a perspective rear view of the ski carrier similar to FIG. 2, but with the lower adjustable strap in a raised vertical position for use by a shorter skier, or for handling longer skis.

In FIG. 2 a front view of the carrier 10 is shown with the lower ends 26 and 28 of the front and rear straps 20 and 22 in an open position ready to receive a portion of a pair of skis therein. Also, a front view of the ski pole strap 32 is shown in an open position ready to receive a portion of a pair of ski poles therein. Also seen in this view and in FIGS. 1, 3 and 4 are a pair of gussets 52 attached to a portion of the front and rear straps 20 and 22 and a portion of the lower ends 26 and 28 to maintain and reinforce the angular relationship of the straps and ends and shown more clearly in FIG. 4. Also, the gussets 52 help stabilize the area of the saddle 24 and prevent stretching of the strap material during the use of the carrier 10.

FIG. 3 is a rear view of the carrier 10 and similar to FIG. 2, but with the length of the lower adjustable strap 18 shortened for use by a shorter skier or when a skier uses longer skis. The strap 18 is lengthened or shortened by decreasing or increasing the loop made by the threaded upper ends 45 and 47 of the straps 20 and 22. By having both the front strap 20 and rear strap 22 adjustable, the saddle 24 is kept in a horizontal position as it is raised or lowered. It can be appreciated that if there was only a single triglide for length adjustment, for example the front triglide 46, then when the length of the front strap 20 was lengthened or shortened, the saddle 24 would move out of balance from the horizontal and the skis attached thereto would be skewed at an angle from the vertical, defeating the clear advantages of why the skis should be held in an substantially vertical position.

The subject carrier 10 preferably comes in two sizes. A child size for people under 5 feet tall, and an adult size for people over 5 feet tall. The only difference in the two sizes is the overall length of the front and rear straps 20 and 22 being shorter for the child-size carrier. Also, the adjustability of the carrier 10 is important for skiers who change length of skis from day to day. For example, on one day a skier may be skiing on moguls and use a shorter ski. In this instance he would use a longer length of carrier as shown in FIG. 2. On another day the skier may desire a longer and faster ski when skiing a slalom course, and in this instance he would shorten the carrier 10 as shown in FIG. 3 so that the longer ski tails would not contact the ground surface when the carrier 10 is in use.

Figure 5:
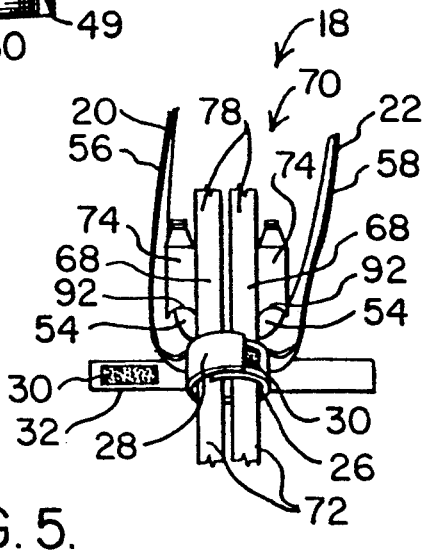
FIG. 5 is a front view of the saddle of the lower adjustable strap with the lower ends of the front and rear holding straps wrapped around a portion of a pair of skis and below the toe bindings of the slits with the skis held in an substantially vertical position.

FIGS. 4 and 5 show the importance of the angle between the straps 20 and 22, and their relationship to gussets 52 and saddle 24 for maintaining the skis 70, and especially the toe bindings, in a controlled vertical orientation. Straps 20 and 22 lie at an angle of about 145° to one another, as shown in FIG. 4. Then, when skis 70 are held in saddle 24 by lower straps 26 and 28, and lifted, straps 20 and 20 and 22 and gussets 52 are capable of extending around toe clips 74. The support which is thus provided by straps 20 and 22 and gussets 52 around toe clips 74 and attached skis 70, along with the orientation of saddle 24, as detailed above, provides the automatic vertical orientation of skis 70. Should the angle between straps 20 and 22 lie at an angle much greater or lesser than about 145° to one another, the orientation of the skis may vary, or be less stable.

Figure 6:
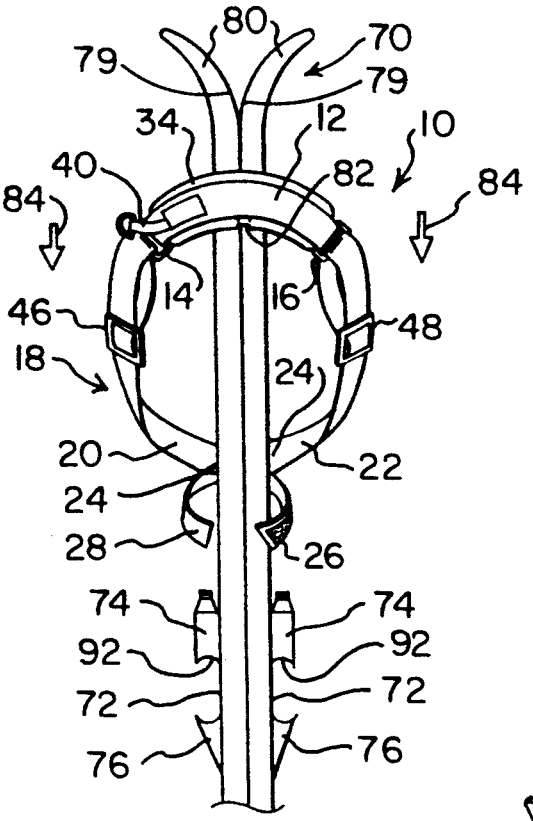
FIG. 6 and FIG. 7 illustrate an installation of the shoulder strap ski carrier on a pair of skis.
Figure 7:
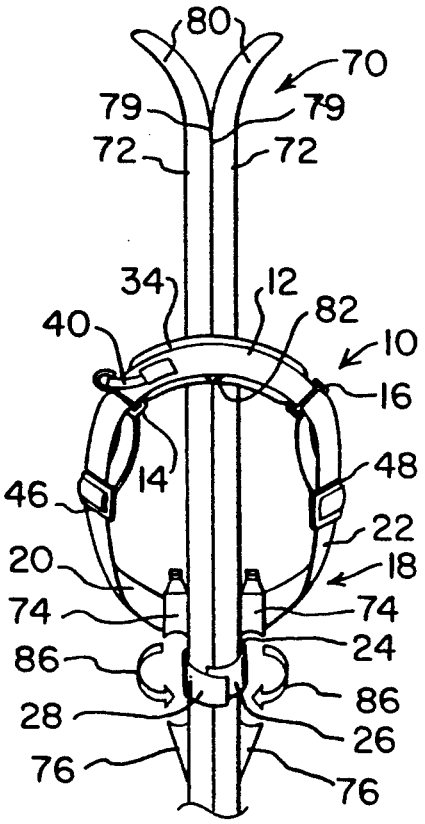

Referring again to FIG. 5, a portion 68 of a pair of skis having general reference numeral 70 is received in the saddle 24 with one side of the skis 70 disposed against the saddle 24 while the lower strap ends 26 and 28 are wrapped around a top portion 72 of the skis 70, between toe bindings 74 and the heel bindings 76, shown in FIGS. 6, 7, and 8. The lower strap ends 26 and 28 are long enough to be able to connect with each other on top of an opposite side 78 of skis 70 and are secured tightly around the skis and attached to each other, using attachment material 30. In preferred embodiments, toe bindings 74 will engage straps 20 and 22 and gussets 52 to in a manner which assures a stable vertical orientation of skis 70.

FIGS. 5 provides a view of ski pole strap 32 which is shown separately attached to the rear of the saddle 24 in an open position for receiving ski poles 90. It is seen that ski pole strap 32 is in a horizontal orientation for securing the ski poles in a vertical position. It is also seen that the separate nature and location of ski pole strap 32 provides a structure which allows for the quick release of the ski poles, so that, for example, the skis with the shoulder strap carrier attached thereto can be carried on the exterior of a vehicle, and, as is often required, the ski poles can be easily removed and carried by the skier inside of the vehicle.

In FIG. 6 and FIG. 7 the steps for securing skis 70 to carrier 10 are illustrated. As shown, the skis 70 are placed next to each other with the ski bottoms 79 placed against each other to protect the flat skiing surface. The loop of the carrier 10 is slipped over ski tips 80 of skis 70 with an orienting tab 82 on the shoulder padding 34 facing down. The saddle 24 is lowered, as indicated by arrows 84, until it is between the toe bindings 74 and heel bindings 76 and against the sides of the skis 70. The ends 26 and 28 of the front strap 20 and rear strap 22 are now wrapped tightly around the skis 70 as indicated by arrows 86 and secured to one another. The skis 70 and carrier 10 can now be turned around and shafts 88 of ski poles 90 can be secured with ski pole strap 32 wrapped therearound as shown in FIG. 8.

In FIG. 8 a rear silhouette of a skier 89 is shown using the carrier 10 for transporting his skis 70 and poles 90. In this illustration the skis 70 and poles 90 have been properly attached to the carrier 10 with the carrier 10 holding the skis 70 and poles 70 in a vertical position to the rear of the right shoulder and beside the waist and right hip of the skier, leaving the skier's hands free for use. In this view strap 20 and gusset 52 can be seen crossing over the top of toe binding 74. As detailed above, when toe bindings 74 are engaged by straps 20 and 22 and gussets 52 vertical orientation of skis 70 is assured.

Should poles 90 be without pole straps as shown in FIG. 8, the carrier 10 is packaged with an added pole "T loop" strap 94 made of similar material as the carrier 10 and used to hold the pole handles 91 adjacent the skis 70. The "T loop" strap 94 has a strap arm 95 with one end attached to a loop 96 received over one of the ski tips 80. The other end of the strap arm 95 is attached to a second pole strap 98 with attachment material 30 thereon. The second pole strap 98 is wrapped around a portion of the pole shafts 88 under pole handles 91, and the ends of the strap 98 secured to each other holding the poles 90 therein.

The ski and pole carrier of the present invention is simple in construction, and can be produced of lightweight, streamlined, durable and rugged off the shelf strapping and other material. It can be produced in a multitude of pleasing colors.

It is thus seen that the present invention provide a shoulder strap carrier for the hands free holding of a pair of skis in an substantially vertical position close to the body of the user, which carrier utilizes a single connection to hold the skis together and in a vertical position. This is accomplished by a single connection strap and saddle combination which, when wrapped around a pair of skis automatically, holds the skis together and positions them in a vertical orientation when suspended from a strap carrier. This arrangement leaves the hands of the user free for other uses, and allows a user to walk safely among others without fear of being caught in a narrow space or of sticking or spearing another person with horizontal skis or poles. The present invention also provides such a carrier with a quick release single ski pole strap so that the skis with the shoulder strap carrier attached thereto can be carried on the exterior of a vehicle, and, as is often required, the ski poles can be carried by the skier inside of the vehicle. As explained, the ski carrier of the present invention can be quickly and easily attached to a pair of skis and ski poles. It is also capable of being uniformly vertically adjusted for users of different heights, and skis of different lengths, without losing its vertical orientation. When not being used to carry skis and poles, the carrier of the present invention is constructed to be easily folded for compact storing in a ski parka pocket, fanny pack, and the like. As noted, preferred embodiments of the carrier are padded for user comfort when carried over a shoulder while transporting skis and poles.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A shoulder strap carrier for placement on a shoulder of a skier and holding a pair of skis and ski poles in an substantially vertical position when the carrier is in use, the carrier comprising:

an upper shoulder strap adapted for receipt on the shoulder of a skier, said upper shoulder strap having opposite ends extending downwardly; and a lower strap having a front strap with an upper end and a lower end and a rear strap with an upper end and a lower end, said upper ends of said front and rear straps adjustably attached to said opposite ends of said upper shoulder strap, said lower ends of said front and rear straps crossed at an angle and attached thereto forming a saddle in a lower portion of said lower strap, said lower ends of said front and rear straps extending outwardly from said saddle for engaging and wrapping around a portion of the skis and holding the skis in the substantially vertical position.

2. The carrier as described in claim 1 further including a pair of loops attached to said opposite ends of said upper shoulder straps, said upper ends of said front and rear straps threaded through said loops and adjustable thereon.

3. The carrier as described in claim 2 further including a pair of triglides slidably mounted on said front and rear straps, said upper ends of said front and rear straps attached to said triglides.

4. The carrier as described in claim 1 further including shoulder padding attached to a bottom side of said upper shoulder strap and along a length of said upper shoulder strap.

5. The carrier as described in claim 1 further including a ski pole strap having attachment material thereon, said ski pole strap mounted on said saddle and extending outwardly therefrom, ends of said ski pole strap having ends adapted for wrapping around a portion of the ski poles and secured to each other by attachment material thereon.

6. The carrier as described in claim 1 wherein said lower ends of said front and rear straps cross at an angle in a range of 55° from the horizontal.

7. The carrier as described in claim 6 wherein said lower ends of said front and rear straps after crossing at an angle in the range of 55° from the horizontal are folded at an angle of 20° from the horizontal and extend outwardly from said saddle at this angle.

8. The carrier as described in claim 1 wherein said lower ends of said front and rear straps include attachment material thereon for securing said lower ends to each other when wrapped around a portion of the skis.

9. The carrier as described in claim 1 wherein said upper shoulder strap and said lower strap are made of polypropylene, nylon, and like material.

10. A shoulder carrier for transporting ski equipment, said carrier comprising;

an upper member;

means on said upper member for mounting said carrier on the shoulder of a person;

a lower member;

means on said lower member for securing the ski equipment to said carrier; and means on said lower member for holding the ski equipment in a substantially vertical position above the surface of the ground wherein said ski equipment holding means include:

a first flexible member extending outwardly from said lower member; and a second flexible member extending outwardly from said lower member in a direction away from and at an angle to said first flexible member wherein said first flexible member and said second flexible member form a saddle for holding the ski equipment in a substantially vertical orientation.

11. The carrier of claim 10 wherein said angle between said first flexible member and said second flexible member is about one hundred forty-five degrees.

12. The carrier of claim 10 wherein said carrier further comprises:

second means for holding ski equipment in a substantially vertical position.

13. The carrier of claim 10 wherein said ski equipment holding means include:

reinforcement means attached to said first flexible member and to said second flexible member to maintain said angle between said first flexible member and said second flexible member.

14. The carrier of claim 10 wherein said means for securing the ski equipment includes:

means for securing said first flexible member and said second flexible member together around the ski equipment to secure the ski equipment in said saddle.

15. The carrier of claim 10 wherein said carrier further comprises:

means for adjusting the distance between said shoulder mounting means and said ski equipment holding means.

16. The carrier of claim 10 wherein said upper member includes a first elongated strap;

said lower member includes a second elongated strap; and means for securing each end of said first elongated strap to an opposing end of said second elongated strap to form a substantially oval-shape.

17. The carrier of claim 10 wherein said carrier further comprises:

means on said carrier for securing said ski equipment holding means from rotational movement relative to said lower member.

18. A shoulder carrier for transporting ski equipment, said carrier comprising:

an upper member including a first elongated strap;

means on said upper member for mounting said carrier on the shoulder of a person;

a lower member including a second elongated strap;

means on said lower member for securing the ski equipment to said carrier including means for securing each end of said first elongated strap to an opposing end of said second elongated strap to from a substantially oval-shape; and means on said lower member for holding the ski equipment in a substantially vertical position above the surface of the ground wherein said ski equipment holding means include:

a first strap portion extending outwardly from said second elongated strap;

a second strap portion extending outwardly from said second elongated strap away from and at angle to said first strap portion to form a saddle for holding the ski equipment in a substantially vertical orientation; and said securing means include means for securing said first strap portion and said second strap portion together around the ski equipment.

19. The carrier of claim 18 wherein said ski equipment holding means further include:

means on said second elongated strap for securing said first strap portion and said second strap portion from rotational movement relative to said second elongated strap.

20. The carrier of claim 18 wherein said carrier further comprises:

means for adjusting the distance between said shoulder mounting means and said ski equipment holding means.

21. The carrier of claim 18 wherein said carrier further comprises:

a third strap end portion extending outwardly from said lower strap;

a fourth strap end portion extending outwardly from said lower strap away from said third strap portion to form a saddle for holding ski equipment in a substantially vertical position; and means for securing said third strap portion and said fourth strap portion around ski equipment.

* * * * *